United States Patent [19]

Barkdull, Jr.

[11] 4,454,620

[45] Jun. 19, 1984

[54] SPAN CONSTRUCTION

[76] Inventor: Howard L. Barkdull, Jr., 15117 Edgewater Dr., Lakewood, Ohio 44107

[21] Appl. No.: 337,317

[22] Filed: Jan. 6, 1982

[51] Int. Cl.[3] ..... E01D 11/00

[52] U.S. Cl. ..... 14/20; 52/2; 52/84; 244/219

[58] Field of Search ..... 14/19, 1, 27, 18, 20; 52/84, 2; 244/219, 219 A

[56] References Cited

U.S. PATENT DOCUMENTS

| | | | |
|---|---|---|---|
| 11,467 | 8/1854 | Baldwin | 14/1 |
| 1,400,078 | 12/1921 | Kempton | 52/2 X |
| 2,423,832 | 7/1947 | Gearon | 14/27 |
| 2,682,274 | 6/1954 | Miller | 135/5 |
| 2,979,287 | 4/1961 | Ross | 244/219 A X |
| 3,258,800 | 7/1966 | Robinsky | 14/1 X |
| 3,389,877 | 6/1968 | Huber et al. | 244/1 |
| 3,420,331 | 1/1969 | Minnite | 14/27 X |
| 3,495,286 | 2/1970 | Harper | 14/1 |
| 3,688,327 | 9/1972 | Marshall | 14/1 |
| 3,726,375 | 4/1973 | Blate et al. | 193/253 |
| 3,808,624 | 5/1974 | Barkdull | 14/1 |
| 3,859,682 | 1/1975 | Sulkiewicz | 14/3 |
| 3,894,307 | 7/1975 | Delamare | 14/27 |

*Primary Examiner*—William F. Pate, III
*Assistant Examiner*—Beverly E. Hjorth
*Attorney, Agent, or Firm*—Squire, Sanders & Dempsey

[57] ABSTRACT

A span construction having longitudinal cables extending between end supports, a flexible sheath enclosing the volume bounded by cables and end supports, a fan for forcing a gas through the sheath and gas escape holes on the underside of the sheath to raise the span in response to escaping gas. The span may have an airfoil cross-section so that it is raised in response to cross wind loading.

8 Claims, 5 Drawing Figures

SPAN CONSTRUCTION

This invention relates to improvements in spans such as bridges, viaducts and the like for carrying vehicular traffic, conveyors, pipe lines and bulk materials between two points and more particularly to a novel flexing span construction capable of reducing or eliminating catenary sag and statically and dynamically reacting to and resisting transverse wind loading.

The usual method of constructing a bridge or span between two points separated, but not widely, by water, a chasm or the like, is to construct a truss structure between the points, upon which decking forming a surface for a road or other way may be placed. More widely separated points usually require suspension of cables from towers located at each of the end points. A pan is then supported by additional vertical cables attached to the longitudinal, principal cables. Long spans require additional supporting towers intermediate of the end points of the span. A roadway or the like is then contructed on the suspended pan. The roadway is generally a stiff substructure of relatively rigid struts and beams. Unless the cable suspension system is adequately stiffened, the suspended roadway is subject to undulations and flexings which can make the span difficult to traverse and vibrations induced by traffic and transverse wind loads can compound to magnitudes and frequencies which may cause the span to fail and collapse. Each span of a suspended bridge structure has a natural tendency to hang in the form of a catenary curve. This curvature results in an undesirable low point at the center of the span.

The catenary curvature and swaying due to transverse loading of a suspended span structure are inherent properties of suspended bridges. Huber in U.S. Pat. No. 3,495,286 disclosed a tunnel or bridge-type structure may be statically controlled to some degree by tensioning a selected side of a covering which envelopes the structure. However, the structure disclosed by Huber has no ability to react to dynamic loads. The present invention solves the problems of catenary sag and transverse wind loads by reacting statically and dynamically to the forces producing sag and transverse loads.

SUMMARY OF THE INVENTION

The present invention advantageously includes means for changing the static shape of a span construction and for statically and dynamically adjusting the shape of the span in response to dynamic loading forces. The advantages of the invention are achieved by a closed tunnel-like flexible sheath attached to two end supports or abutments located at the points to be bridged. A plurality of cables are longitudinally suspended between the abutments and have inserted at intervals, transverse closed-figure frame members which maintain a fixed cross-sectional geometry amongst the cables. The flexible sheath is attached to the inside of the frame members to maintain a desired cross-sectional shape and is sealed to the end supports which also aid in maintaining the desired cross section. The cross-sectional shape of the cable, frame, and sheath assembly may be uniform or may vary longitudinally between the end supports. Typical cross sections may be circular or elliptical or the shape of a transverse cross section of an airfoil.

A gas, preferably air, is blown through the sheath. One or more centrally placed apertures on the lower surface of the sheath allow some of the air to escape raising the span and compensating for the catenary sag. The sag reduction eliminates the need for span supports intermediate of the end supports.

Valves actuated by transverse winds may open and close apertures along the sides of the span to allow air to escape from within the sheath and to generate reaction forces compensating for the wind loading forces.

The sheath, through the support frames, may be formed into an airfoil shape which reacts to transverse wind loads by a lifting of the span, reducing sideways deflection caused by transverse winds. The airfoil-shaped frames may be arranged in groups having aligned leading edges within each group and the orientation of the groups alternated along the length of the span.

DESCRIPTION OF PREFERRED EMBODIMENTS

Figure 1:
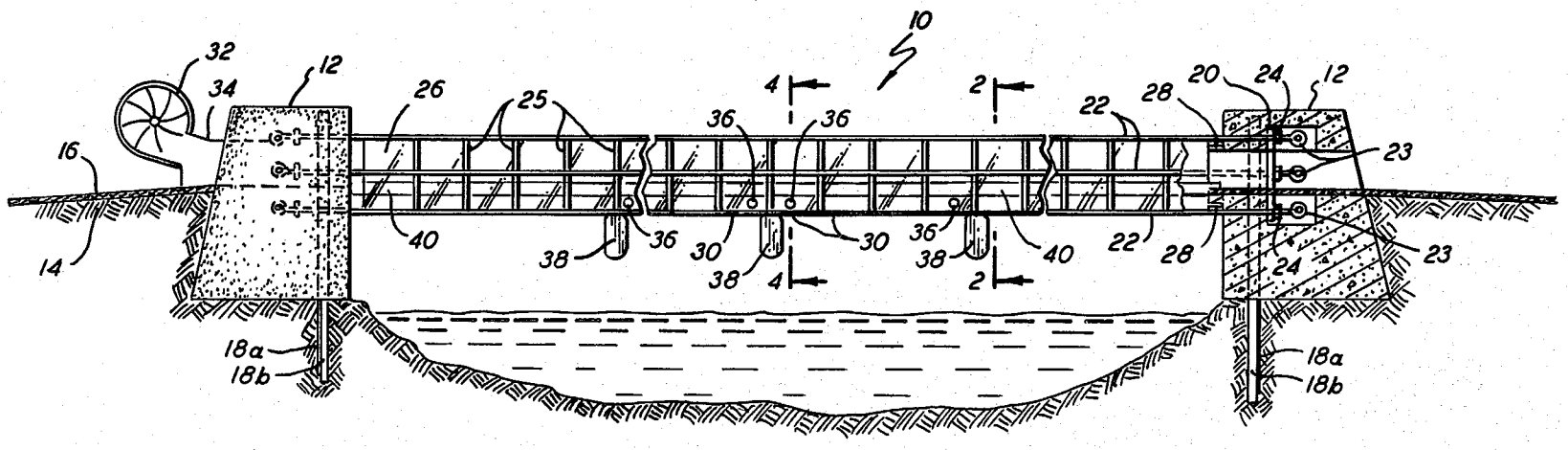
FIG. 1 is a side view, partly in section, of an embodiment of a span construction according to the invention.

Referring to FIG. 1, in which, for purposes of illustration, the elements are shown diagrammatically rather than in proportional dimensions, a span 10 is shown supported by end supports or abutments 12. In the embodiment shown, span 10 forms a vehicular bridge over water, but the span could bridge any two points and might carry a pipeline or conveyor belt or other non-vehicular object transportation means. In FIG. 1, right end support 12 is shown in section. End supports 12 are approached by conventional earth work ramps 14 supporting the paved highway surface 16 at the grade required by the site to join with the roadway surface within the span. End supports 12 are erected on a suitably excavated bed-rock or stable sub-soil base or, if the site is a deep marsh or such that the sub-soil is unstable and too deep over bed-rock or a stable stratum, the abutments may be erected upon suitable piles or sunken mattress slabs in a conventional manner.

The abutments 12 are usually of poured reinforced concrete or similar conventional masonry work, provision being made for the pairs of vertical steel or other high tensile strength anchor rods 18, one pair of which, 18*a* and 18*b*, is shown in FIG. 1 in each abutment. These anchor rods 18 may terminate and be secured within their respective abutments if the abutments are themselves sufficiently large and stable and/or anchored in bed-rock. Or, as shown in FIG. 1, the anchor rods may extend downwardly for anchoring in bed-rock or in piles or suitable similar mattress slabs, to fix and stabilize the abutments. End supports 12 include heavy inner flanges 20 slotted to receive the ends of longitudinal cables 22 and provide a bearing for the cable-securing means 23 and 24, as shown in FIG. 1 at each abutment 12. Cables 22 may be multi-stranded or single stranded depending upon the desired load-carrying capacity of span 10.

A plurality of frame supports 25 are spaced along span 10 transverse to , and in tangential contact with longitudinal cables 22. The frame supports 25 are formed of rigid material, such as aluminum or steel wire, tube, or rod and are joined to cables 22 to allow pivotal movement between the supports and cables. A flexible sheath means, preferably a light-admitting transparent or translucent plastic membrane 26, for enclosing the volume of span 10 defined by end supports 12 and cables 22, lies inside and is attached to frame supports 25. The flexibility of sheath means may be inherent, such as when a flexible material such as plastic sheeting is used; the flexibility may be provided through gas tight flexible joints connecting adjacent sheets of relatively inflexible material to form the sheath means. Sheath 26 is received by annular recesses 28 in end supports 12 which are provided with a conventional substantially air tight seal between the end supports and the sheath means. Sheath 26 includes a gas escape means for altering the shape of span 10 including apertures 30 medially disposed on the lower side of span 10. A gas source means for forcing a gas, such as air, into one end of sheath 26 through one of the abutments 12, could include a jet engine or other turbine type compressor, but preferably comprises a rotary blower 32 coupled through a plenum 34 into abutment 12 and sheath 26. The gas is exhausted through the gas escape means and the entrance to sheath 26 in the opposite abutment 12. The gas escape means also includes apertures 36 in sheath 26 along the sides of span 10 (only one side of span 10 being viewable in FIG. 1). Apertures 36 are opened and closed in response to movement of actuators 38 hanging beneath span 10, as hereinafter explained. A pan means 40 extends between end supports 12 for carrying roadway 16 between the spanned points, i.e., between end supports 12. (The support means for pan means 40 is explained hereinbelow in connection with FIG. 2.)

Figure 2B:
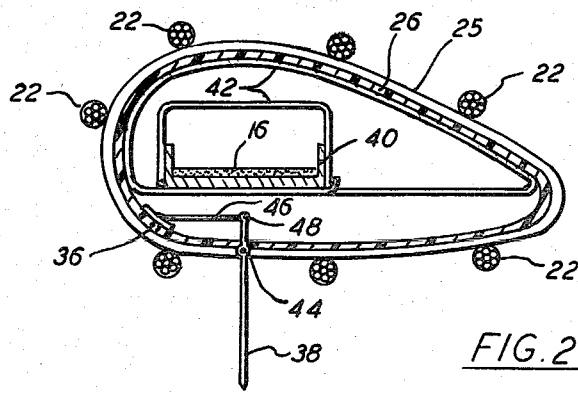
FIGS. 2(*a*) and 2(*b*) are cross-sectional views of alternate embodiments of the span construction of FIG. 1 taken along line 2—2 of FIG. 1.
Figure 2A:
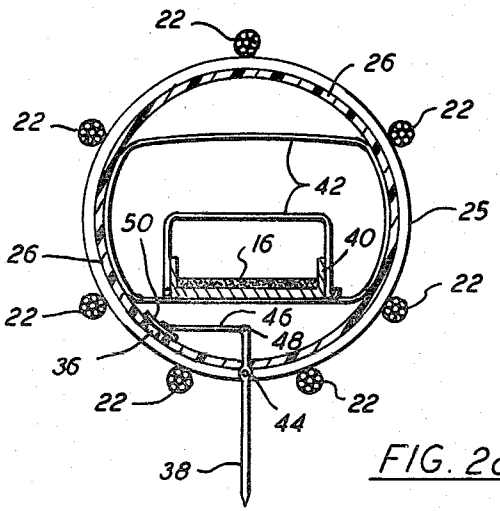

Turning now to FIG. 2(*a*), one embodiment of a cross section of span 10 along line 2—2 of FIG. 1 is shown. In this embodiment, the cross section is circular and has seven cables 22 distributed at the outside. A circular support frame member 25 aids in holding cables 22 in the desired geometry. Sheath 26, the thickness of which is exaggerated for clarity, is joined to the inside surface of frame member 25. An additional rigid, solid or tubular way frame member 42 is fitted against and held in position by frame member 25 of which it may be a part or to which it is attached by welding or the like so it is coupled to sheath 26. The extremities of way frame member 42 describe a closed figure contacting frame member 25 along the sides, but not the upper and lower portions of frame member 25. In addition, way frame member 42 has a closed figure central portion which supports a way base means for supporting a way surface or path through the span. An embodiment of a way base means is a pan means 40 for supporting roadway 16. The way base means might consist of rollers for supporting and driving an endless belt or for supporting a pipe through which gas, a semi-solid, liquid or solid-in-liquid mixture or the like might be pumped. Actuator 38 is pivotally connected to frame member 25 by a pivot 44 and extends through sheath 26 to the interior of the span where a lever arm 46 is connected by pivot 48 to actuator 38. At the opposite end of lever arm 46 a stopper 50 normally plugs aperture 36 in sheath 26 under the influence of a conventional biasing means, such as a spring, not shown. When a force operates in the proper direction, to the right in FIG. 2(*a*), on actuator 38, stopper 50 is withdrawn from aperture 36 opening the interior of span 10 to the outside. The stronger the force, the more widely aperture 36 is opened. The valve means, which comprises the actuator, linkage, stopper and aperture, thus allows some of the air being blown into the span to escape in response to the transverse force acting on actuator 38. Where that force is wind tending to push the span to the left in FIG. 2(*a*), the air escaping through aperture 36 creates reaction force tending to counteract the effects of the wind loading. Thus, the valved gas escape means provides a dynamic response means for altering the shape of the span in response to variable loads. The response means described is referred to herein as dynamic because the load is responded to by a mechanical actuation, i.e., a dynamic response. The gas escape means alters the shape the span would assume if no means of resisting side winds were present. Of course, FIG. 2(*a*) is merely schematic, and symmetrical, independently operating apertures and valve means may be placed on opposite sides of span 10 as well as being distributed longitudinally along the span. The appropriate transverse gas escape means arrangement for a particular application is chosen based on the prevailing wind directions and velocities expected at the span site.

In FIG. 2(*b*), a cross section along line 2—2 of FIG. 1 is shown for an alternative embodiment of span 10. Like elements in FIGS. 2(*a*) and 2(*b*) are numbered the same and function in the same way. The principal difference between the embodiments of FIGS. 2(*a*) and 2(*b*) is the cross-sectional shape of the span. In FIG. 2(*b*), the cross-sectional shape is a transverse section of an airfoil which results in a lifting force when a fluid such as air blows toward its leading edge, on the left in FIG. 2(*b*), or, blows toward its trailing edge, on the right in FIG. 2(*b*). The shape of the span then provides a static response means for altering the shape of the span in response to variable loads. The response means described is referred to herein as static because the load is responded to by an inherent characteristic (shape) of the structure and without other mechanical actuation. Where the embodiment of FIG. 2(*b*) is employed, the static response means improves the transverse wind resistance of the span. The airfoil cross-section of FIG. 2(*b*) augments the dynamic response means in resisting transverse wind loads by altering the shape the span would otherwise assume in the presence of transverse winds. The direction of the wind which produces the maximum lift force may be chosen for a particular span by appropriately selecting the angle with respect to the centroidal axis of the airfoil, at which the cross section of the airfoil is taken as a pattern for the transverse frame member. That is, by properly choosing the airfoil "slice" that the frame member represents, maximum lift can be obtained when the wind direction is neither horizontal nor in a plane perpendicular to the axis of the span. Both FIGS. 2(*a*) and 2(*b*) show seven cables in use, but different numbers of cables may be readily used and spaced around the periphery of frame member 25 as necessary to obtain proper support of the frame members, considering their shape. The geometric relationship of the cables within end supports 12 and the shape described by annular recesses 28 are designed to conform to the cross-sectional shape of the span. That is, for the circular span of FIG. 2(*a*), both the recesses 28 and the slots in flanges 20 for receiving cables 22 would likewise be circular.

Figure 3:
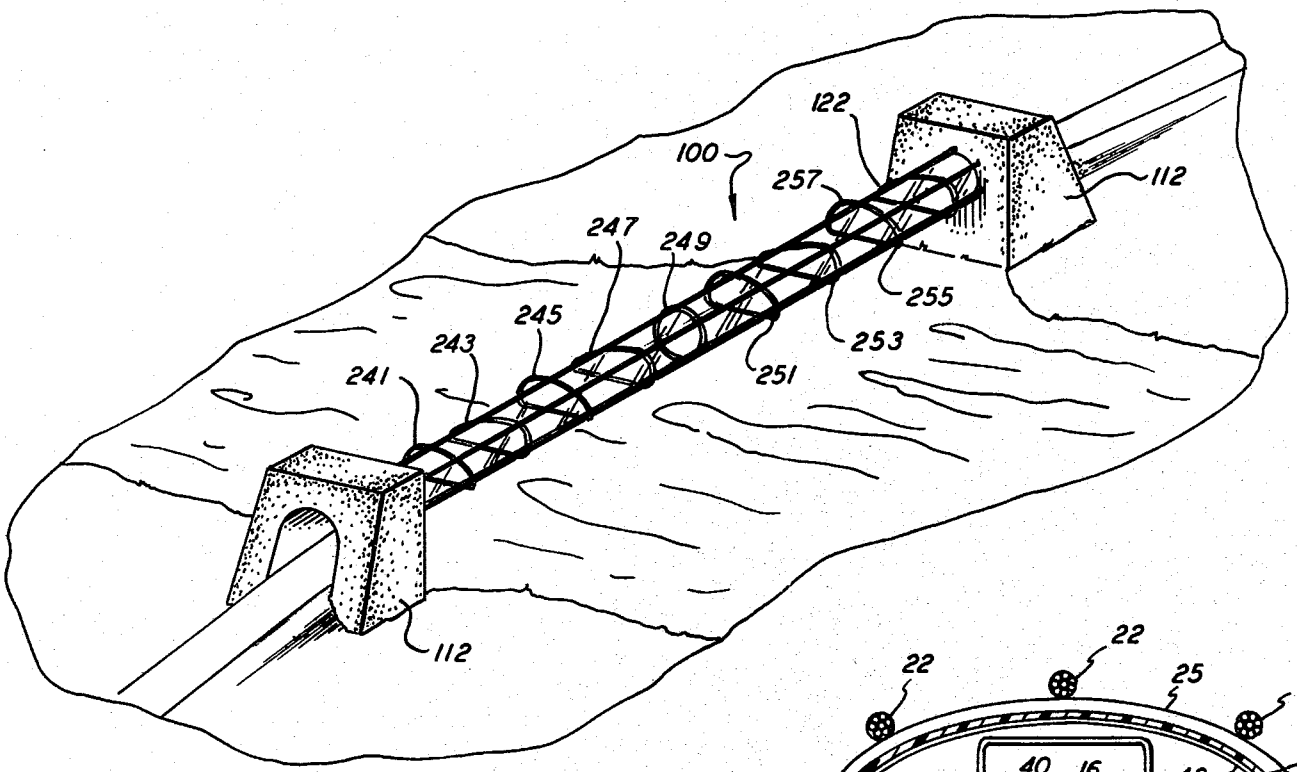
FIG. 3 is a perspective view of an embodiment of a span construction according to the invention.

It is, of course, not essential that the cross section of the span be uniform from one end support to the other. Where the cross section does vary in shape along the length of the span, cable securing means 23 and 24, including the arrangement of slots with flange 20, and recesses 28 are all shaped to aid in maintaining the desired span cross-sectional shape at the end of the span. The transverse cross section variations along the longitudinal dimension of the span are created and maintained by appropriate shaping and arrangement of support frame members 25. A particularly useful arrangement of such a variable cross section span is shown in a perspective view in FIG. 3. (For clarity, many of the details shown in FIG. 1 for span 10 have been omitted from the span shown in FIG. 3, including the way base means and gas escape means.) There, span 100 has abutments 112 and longitudinal cables 122 stretched between abutments 112. The cables lie in tangential contact with frame support members 241, 243, 245, . . . 257. Frame support member 241 has the cross-sectional shape of a transverse section of an airfoil with its trailing edge lying to the right side of span 100 as depicted in FIG. 3. The next adjacent frame support member 243 is likewise formed in airfoil cross section, but with its trailing edge lying to the left side of span 100. Frame support members 245 and 247 repeat the pattern of members 241 and 243. Frame support member 249, at the longitudinal center of span 100, is circular in cross section. Frame support members 251 through 257 are airfoil shapes repeating the alternative pattern of members 241 through 247.

Figure 4:
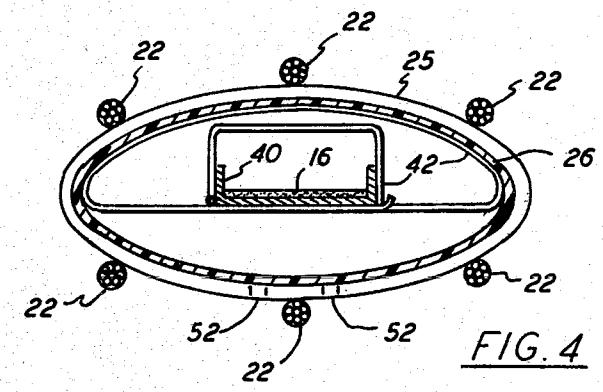
FIG. 4 is a cross-sectional view of yet another embodiment of the span construction of FIG. 1 taken along line 4—4 of FIG. 1.

FIG. 4 shows a cross section of yet another embodiment of a span, this section being taken near the center of span 10 along line 4—4 of FIG. 1. This embodiment has an elliptical cross section which may not be mathematically elliptical, but is generally elliptical. (The valve means shown in FIGS. 2(*a*) and 2(*b*) are omitted from FIG. 4 for clarity.) Like elements in FIG. 4 and FIG. 2 are like numbered. The crosssection of FIG. 4 shows apertures 52 in sheath 26 disposed symmetrically on the lower side of span 10. These dual apertures correspond to apertures 30 of FIG. 1 and comprise gas escape means for allowing air or whatever gas is pumped into sheath 26 to escape. The escaping air produces reaction forces which tend to lift the span. That is, the medially disposed apertures 52 comprise a static response means for altering the shape of the span in response to a constant load, e.g., weight. Again, this response means is referred to as static since there is no mechanical actuation in response to a load. Rather, there is a controllable condition, the degree of lift, that for a particular structure depends upon the pressure of the gas within the span.

When the span is constructed, cables 22 are strung between abutments 12 and drawn taut by cable securing means 23 and 24. These means are conventional and may take the form of eyes formed on the ends of the cables which are looped over hooks which are retracted or threaded sleeves on the cables which may be retracted by tightening nuts 24. Because the cables themselves have mass as do the frame support members, way base means and way frame members, the span will sag in the conventional catenary curve with a low point at the center of the span. The forces created by the escape of gas through apertures 52 counteract that sag. To take full advantage of the invention, it is preferred that the materials used in the span be as lightweight as possible consistent with the load to be carried. Catenary sag may be partially or totally eliminated according to this aspect of the invention. Since the sag is greatest at the center, the sag-reducing gas escape means preferably comprises apertures in the sheath means medially disposed on the lower side of the span. The apertures may appear in pairs, as in FIG. 4, symmetrically distributed about a vertical axis of the span to stabilize any side-to-side movement that might be produced by the escaping gas or may, as in FIG. 1, comprise single apertures lying on that axis. The static response means comprising sag-reducing gas escape means has the special advantage of permitting variation of the height of the span over the surface below. If an object, such as a ship, needs to pass beneath the span but is slightly too tall, the span may be temporarily raised a few percent by increasing the rate of gas escape through the medial, lower side apertures.

Although catenary sag reduction is the principal purpose of constantly open gas-releasing apertures in the span, the same reaction forces can be produced by other apertures placed in the sheath. Thus, the span shpae may be permanently altered from its usual shape by gas escape means lacking a valve means, and located on the sheath means other than medially on the lower side of the sheath.

The span construction thus described is adaptable to numerous applications. The gas pumped through the span will generally be air, but if a sufficient volume of another pressurized gas is available, another gas or gas mixture might be used. Selection of an appropriate gas also depends upon the objects passing through the span, air being essential to vehicular traffic. While emphasis has been placed on describing an embodiment of the invention in which wind blows over it and the wind-created forces are resisted, the invention is equally useful where other fluids pass around the span. For example, the span is also adapted to submarine use where the gas escape means may have upwardly floating actuators to resist variable transverse currents by controlling gas escape rates and directions. Pipelines and communications transmission lines are examples of possible submerged uses. In such applications, the blanket of escaping gas within the sheath means and surrounding the transmission line or pipeline may increase its life by excluding the ambient salt or fresh water.

The invention, by counteracting catenary sag and wind-induced vibrations, permits construction of a single span across water, chasms or the like, with only end supports and without supplemental supports intermediate of the end supports. The invention thereby provides an obvious economic advantage over conventional bridge structures which require such supplemental supports.

The invention has been described with reference to certain preferred embodiments. Various additions, omissions and modifications, within the scope and spirit of the invention will be obvious to those skilled in the art. Therefore, the invention is limited solely by the following claims.

I claim:

1. A naturally sagging span construction comprising two opposing end supports, a flexible sheath attached to each of said end supports to form tubular a surface extending between said end supports, a plurality of longitudinal cables anchored to said end supports, said cables being disposed along and mechanically linked to, said tubular surface, gas source means for forcing a gas into said sheath and gas escape means in said sheath for permitting said gas to escape from said sheath to produce a reaction force reducing the natural sag of said span.

2. The span of claim 1 further including a plurality of spaced frame members, each frame member describing a closed figure and being disposed transversely to and in tangential contact with each of said cables and in circumferential contact with said sheath.

3. The span of claim 2 wherein said frame members describe sections of an airfoil having a leading edge and a trailing edge.

4. The span of claim 2 wherein said frame members describe a circle.

5. The span of claim 2 wherein said frame members describe an ellipse.

6. The span of claim 1 wherein said gas escape means comprises at least one aperture disposed medially along said sheath and on the lower surface of said span.

7. The span of claim 1 wherein said sheath comprises a plastic membrane.

8. The span of claim 1 wherein said gas source means comprises a rotary blower for compressing air and discharging it into said sheath.

* * * * *